United States Patent [19]

Glock

[11] 4,327,750

[45] May 4, 1982

[54] APPARATUS FOR INCREASING THE FILLING CAPACITY OF TOBACCO

[75] Inventor: Eugene Glock, Richmond, Va.

[73] Assignee: American Brands, Inc., New York, N.Y.

[21] Appl. No.: 271,115

[22] Filed: Jun. 8, 1981

Related U.S. Application Data

[60] Division of Ser. No. 931,624, Aug. 7, 1978, Pat. No. 4,271,852, which is a continuation-in-part of Ser. No. 913,246, Jun. 6, 1978, Pat. No. 4,161,953, which is a continuation of Ser. No. 744,042, Nov. 22, 1976, abandoned, which is a continuation of Ser. No. 628,912, Nov. 5, 1975, abandoned, which is a continuation of Ser. No. 40,726, May 20, 1970, abandoned.

[51] Int. Cl.[3] ..... A24F 0/00

[52] U.S. Cl. ..... 131/292; 131/294; 131/296

[58] Field of Search ..... 131/290, 291, 292, 294, 131/296

[56] References Cited

U.S. PATENT DOCUMENTS

| | | | |
|---|---|---|---|
| 2,227,634 | 1/1941 | Dalin | 131/291 |
| 2,388,917 | 11/1945 | Hormel | 34/5 |
| 2,435,503 | 12/1950 | Levinson et al. | 34/5 |
| 2,533,125 | 12/1950 | Levinson et al. | 34/5 |
| 2,596,183 | 5/1952 | Sowa | 131/291 |
| 3,020,645 | 2/1962 | Copson | 34/5 |
| 3,059,086 | 10/1962 | Pedersen | 34/5 |
| 3,135,589 | 6/1964 | Stokes | 34/5 |
| 3,199,217 | 8/1965 | Oldenkamp et al. | 34/5 |
| 3,222,796 | 12/1965 | Jeppson | 34/5 |
| 3,223,090 | 12/1965 | Strubel et al. | 131/291 |
| 3,233,333 | 2/1966 | Oppenheimer | 34/5 |
| 3,270,433 | 9/1966 | Nerge et al. | 34/5 |
| 3,271,874 | 9/1966 | Oppenheimer | 34/5 |
| 3,289,314 | 12/1966 | Porta | 34/5 |
| 3,290,788 | 12/1966 | Seelandt | 34/5 |
| 3,376,652 | 12/1966 | Fernandez, Jr. | 34/5 |
| 3,616,542 | 11/1971 | Rader | 34/5 |
| 3,673,698 | 7/1972 | Guerard | 34/5 |
| 3,785,385 | 1/1974 | Johnson | 131/291 |
| 3,883,958 | 5/1975 | Philipe | 35/5 |

FOREIGN PATENT DOCUMENTS

| | | | |
|---|---|---|---|
| 1815169 | 7/1969 | Fed. Rep. of Germany | 131/291 |
| 521224 | 5/1940 | United Kingdom | 131/29 |

*Primary Examiner*—V. Millin

*Attorney, Agent, or Firm*—Pennie & Edmonds

[57] ABSTRACT

The invention disclosed is an apparatus for increasing the filling capacity of cured tobacco by evaporatively freeze-drying water expanded tobacco and effecting heating of the tobacco by infrared radiation. The treated tobacco has increased filling capacity without suffering disadvantageous results.

5 Claims, 4 Drawing Figures

APPARATUS FOR INCREASING THE FILLING CAPACITY OF TOBACCO

RELATIONSHIP TO OTHER APPLICATIONS

This application for United States Patent is a division of application Ser. No. 931,624, filed Aug. 7, 1978 now U.S. Pat. No. 4,271,852, which is a continuation-in-part of application Ser. No. 913,246, filed June 6, 1978 now U.S. Pat. No. 4,161,953, which is a continuation of application Ser. No. 744,042, filed Nov. 22, 1976 now abandoned, which, in turn, is a continuation of application Ser. No. 628,912 filed Nov. 5, 1975, now abandoned, which is a continuation of application Ser. No. 40,726, filed May 20, 1970, also now abandoned.

BACKGROUND OF THE INVENTION

1. Field of the Invention

The present invention relates to a method and apparatus for increasing the filling capacity of tobacco by infrared radiation heating of water expanded tobacco under freeze-drying conditions.

2. Description of the Prior Art

The tobacco art has long recognized the need to effect the greatest possible degree of expansion of tobacco while maintaining desirable handling and smoking characteristics. Correspondingly, numerous attempts have been made in the art to effect such expansion of tobacco, frequently by treatment of the tobacco with an agent which expands greatly during evaporation or after a decrease in pressure.

One attempt in the prior art to expand tobacco is disclosed in U.S. Pat. No. 1,789,435 which teaches a method for expanding the volume of tobacco in order to make up the loss of volume caused in curing the tobacco leaf. The tobacco is contacted with a gas such as air, carbon dioxide, or steam under pressure and, upon release of the pressure, the tobacco tends to expand limitedly between 5% and 15% by volume.

Prior art disclosures are also available which teach that tobacco may be expanded by addition of water to the tobacco which causes the tobacco to swell following which the contained moisture is evaporated to set the expansion.

Another attempt to expand tobacco has been by use of carbohydrates as a means to improve puffing of tobacco stems. In this process the tobacco stems are soaked in an aqueous solution of carbohydrate following which they are heated to set the tobacco expansion.

Volatile organic liquids have also been disclosed in the prior art as means to effect expansion of tobacco.

Methods have also been proposed in the prior art to effect tobacco expansion by use of ammonia and carbon dioxide gases. Carbon dioxide has also been used in the liquid state as a means of expanding tobacco as well as other organic plant substances. Typically, such processes require immersing, for example, tobacco in a pool of liquid carbon dioxide wherein the tobacco is steeped in the liquid carbon dioxide following which the tobacco is heated, preferably using super-heated steam to set the expansion. This method, however, invites various disadvantages by requiring needlessly large quantities of liquid carbon dioxide relative to the amount of carbon dioxide which actually impregnates the tobacco. Furthermore, components of the tobacco such as sugars and flavoring materials are typically extracted by the use of excess liquid carbon dioxide and a corresponding loss of tobacco flavor is experienced.

Tobacco stems and veins have been expanded heretofore by treatment with steam such that moisture penetrates the fibrous structure and by then heating the moisturized stems, or exposing them to a vacuum, the fibrous mass becomes expanded. The same treatment has been tried with laminar tobacco, but when the treated product is dried the expansion decreases and the dried tobacco has substantially the same volume which existed before treatment.

A more effective expansion of laminar tobacco such as shreds used for cigarettes has been achieved heretofore by soaking the shreds in a relatively large volume of cold water and thereafter freeze-drying the water expanded tobacco. The amount of cold water required has been about eight times the weight of the tobacco treated, and soaking in this amount of water for close to one hour, or even more, has been necessary to obtain the desired expansion of the tobacco. During this soaking period a considerable amount of the water-soluble constituents of the tobacco are extracted in the water. Stirring of the tobacco during the soaking period has been attempted and found to be undesirable because of the tendency of the tobacco shreds to tangle or mat. When expansion of the tobacco is effected in this way, the entire mass of water and tobacco is frozen into a single block of ice in which the tobacco is concentrated at the top of the ice block and the water-soluble extractives are concentrated in the lower main body of the ice block. The ice block is next evaporated in a vacuum with resulting formation of a dry product consisting essentially of the the expanded shreds lying on a film-like layer of water-extracted solids which must then be re-combined. The resulting product is characterized by an objectionable amount of tackiness because of the hygroscopicity of the film-like component which forms a surface layer on the shred portion of the re-combined material.

The rate of heat transfer in a vacuum using conventional freeze-drying methods which employ heated shelves, plates or platens is relatively slow because metal-to-metal contact is usually only at three points and tobacco strips or shreds have surface irregularities which allow only minimal surface contact with a metal tray. It is well known that heat transfer by conduction is restricted to the contact points and that heat transfer by convection is extremely limited at reduced pressures. In conventional freeze-drying, the shelves are usually overheated to improve the drying rate, but this overheating can readily cause contact point scorching.

It has now been found that by practice of the present invention evaporative freeze-drying of tobacco on infrared transparent trays under vacuum may be more effectively achieved by means of infrared radiation heating. It is found that infrared radiation transfers heat exceptionally well in a vacuum and will present the heat to the entire exposed surface of the tobacco rather than to the usual three metal-to-metal contact points. Also, scorching will be avoided by direct infrared radiation from a controlled source. In addition, the infrared radiation increases the heat transfer rate and there is a corresponding decrease in the freeze-drying time. Further advantages of infrared over other forms of radiation such as microwave or dielectric heating include the absence of corona discharge, and the simplicity of producing, directing and using infrared energy, particularly in a vacuum system.

It has also now been found that by practice of the present invention tobacco expansion may be effected which yields a non-tacky puffed product admirably suited for further processing into a smoking product.

SUMMARY OF THE INVENTION

Generally stated, the present method for expanding tobacco tissue is by admixing water, either hot water and/or saturated steam with the tobacco to effect swelling, the water being in an amount such that substantially all of the water has been absorbed by the tobacco and has effected expansion of the cells thereof and associated colloids of the tobacco, thereafter freeze-drying the resulting water-treated tobacco to retain the expanded condition and then moisture conditioning the tobacco before further processing.

The apparatus of the present invention includes a chamber containing at least one support frame fitted with infrared radiation heating elements positioned to aid the evaporatively freeze-drying of the tobacco.

Practice of the present invention will become more readily apparent from the following detailed description taken in conjunction with the drawings.

DESCRIPTION OF THE PREFERRED EMBODIMENTS

Figure 1:
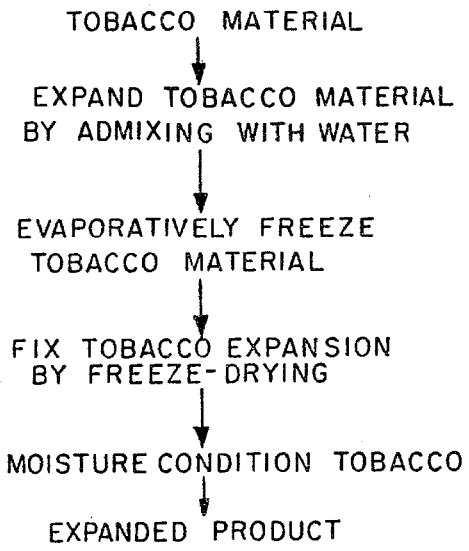
FIG. 1 illustrates the method steps of the present invention.

FIG. 1 illustrates the steps of the method of the present invention where tobacco is first expanded by admixing the tobacco with water, the water preferably being at a temperature of at least about 70° C. Thereafter, the water expanded tobacco is evaporatively frozen and the frozen, expanded tobacco material is freeze-dried while being heated by infrared radiation. The evaporatively freeze-dried tobacco is moisture conditioned before being recovered for use as a tobacco filling material in cigarettes and the like.

Figure 2:
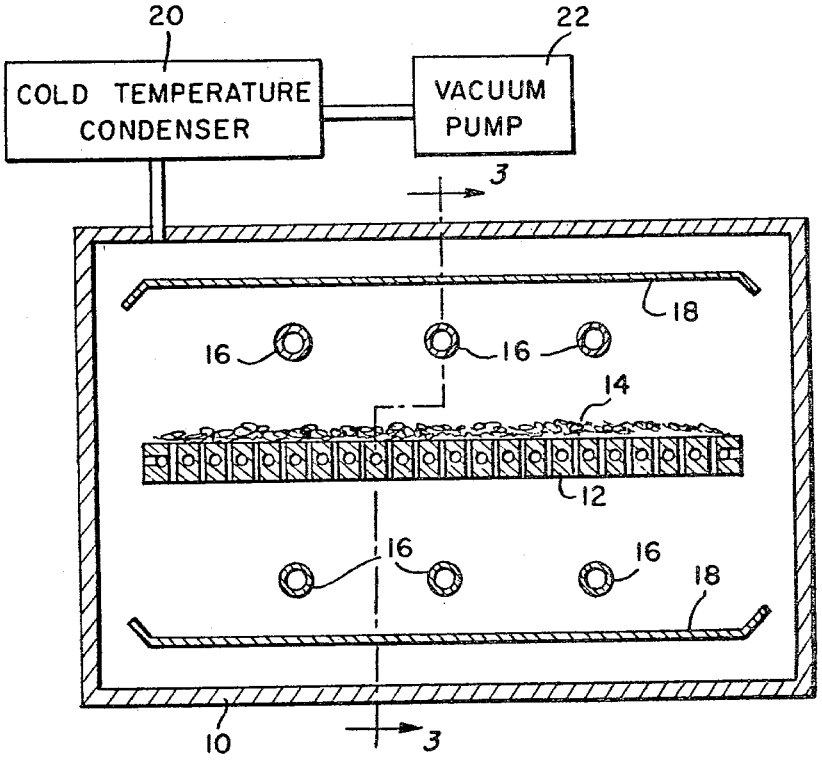
FIG. 2 is a side elevational cross-sectional view of the evaporatively freeze-drying chamber of the present invention.
Figure 3:
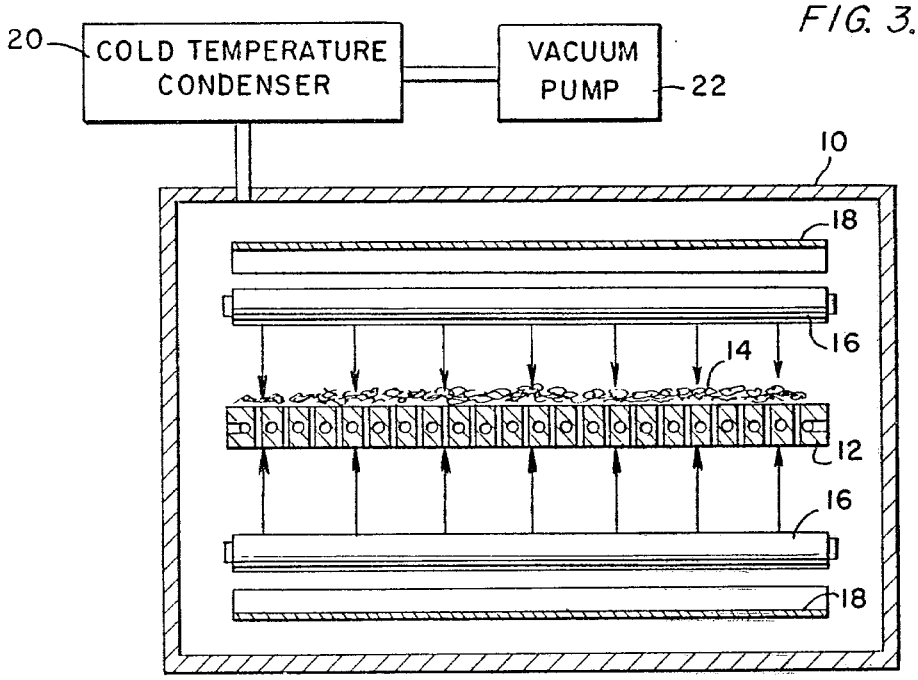
FIG. 3 is a front elevational sectional view of the evaporatively freeze-drying chamber taken along sectional lines 3—3 of FIG. 2.

FIGS. 2 and 3 illustrate diagrammatically an apparatus of the present invention. The apparatus includes a vessel 10 within which is disposed at least one perforated shelf 12 onto which tobacco admixed with water 14 is exposed. Also included in vessel 10 are sources of infrared radiation such as for example, radiant heat quartz lamps 16 and, if desired, for efficiency purposes, reflectors 18. The reflectors may be positioned both above and below the water-containing tobacco to more effectively heat the tobacco material. In order to evaporatively freeze-dry the tobacco, cold temperature condenser 20 is positioned in communication with vessel 10 and also in communication with vacuum pump 22. When vacuum is being drawn on the vessel, evaporatively freeze-drying is initiated. Although the apparatus of the present invention is illustrated as a non-continuous processing vessel, it will be apparent that modifications may be made therein such that continuous operation is achieved. In continuous processing, the tobacco containing water is transported through a vessel having means for containing a vacuum heat source or other necessary means to evaporatively freeze-dry the tobacco being processed therein. The method and apparatus of the present invention are also applicable to all tobacco materials, including stems and veins.

Figure 4:
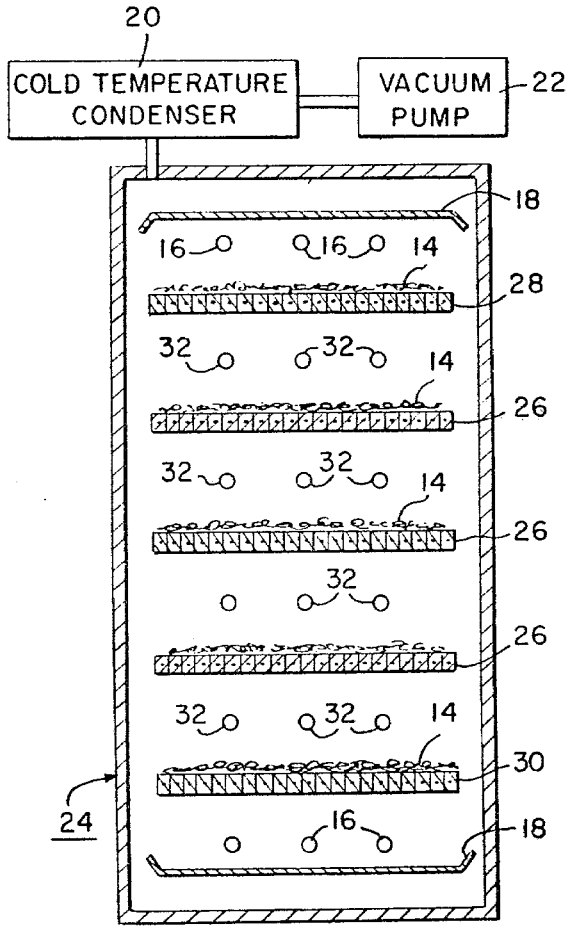
FIG. 4 illustrates diagrammatically an embodiment apparatus of the present invention wherein multiple shelves are included.

FIG. 4 illustrates an embodiment apparatus 24 which is similar to the device of FIGS. 2 and 3 except that it contains multiple perforated shelves 26 interiorly disposed with regard to an upper perforated shelf 28 and a lower perforated shelf 30. Upper and lower perforated shelves may include sources of infrared radiation such as quartz tubular radiant heaters which may be optionally shielded by reflectors 18 if desired. Similarly, lower perforated shelf 30 may include reflectors 18 disposed relative to the heat quartz lamps 16. Because of the positioning of the intermediate perforated shelves 26, it is found typically unnecessary to include reflectors for heaters 32 since these intermediate heaters radiate energy to the top of one tray and the bottom of the other. It will be apparent that the infrared sources are suitably attached to electrical connections to permit operation. Also, control mechanisms not illustrated but commercially available may be included in association with the apparatus of the present invention to permit controlled heating of the tobacco either by directly controlling the temperature of the infrared radiation or, alternatively, if desired, by pulsating the energy received from the radiant heaters. The length of time necessary to achieve evaporatively freeze-drying will vary depending upon the depth of tobacco being processed and the degree of vacuum achieved by pump 22 in association with the temperature of the refrigerated condenser 20.

The method of the invention uses saturated steam and/or hot water. Hot water penetrates the waxy natural surface of tobacco tissue more rapidly than cold ater and thus shortens the treating time over that required when using cold water, and provides greater swelling of the tobacco tissue for a given amount of water. In such a treatment, the hot water penetrates the tobacco and causes swelling of the cells and associated colloids. Any excess of water beyond that which causes this swelling will be held in the tissue by capillary action as long as the amount of hot water used is limited to that which will be substantially completely abosrbed by the tobacco. Although the capillary water may tend to extract some watersoluble material from the tobacco, the extractives are nevertheless held within the capillaries or in interstices and do not come to the surface of the tissue to any significant extent. Thus, by essentially eliminating the presence of any standing water in contact with the tobacco being treated, there is considerable reduction of transfer of the hygroscopic extractives to the surface of the tissue where they could cause tackiness of the tissue. The amount of hot water droplets used in practicing the present invention is, therefore, generally restricted to about 1 to about 5 parts by weight of water per part of tobacco (dry basis) in order to achieve the desired cell wall swelling, and possibly capillary water accumulation, without any significant amount of free-standing water being present.

The temperature of the hot water droplets used in practicing the invention should be at least about 70° C. and preferably at least 90° C. Water at its boiling point, or at temperatures above its boiling point under pressure, can also be used. The high temperature of the treating water, and its use for only a short period of time, as required for effecting the desired expansion pursuant to the invention, has been found not to significantly affect either the manufacturing or the smoking quality of the tobacco. Maintenance of the desired treating temperature, and concomitant use of minimum treating time, can be facilitated by the presence of high temperature steam although, as explained hereinbefore, the steam contributes very little to the amount of water available for penetration and swelling of the tobacco cell walls.

The hot water droplets may be applied to the tobacco pursuant to the invention in the form of a spray. The spray may be formed by atomization with the assistance of air, but in this case the air should be hot in order not to cool the water droplets. Steam can also be used as such or to form the spray by atomization.

The water droplets can be applied to the tobacco while the latter is being carried mechanically through a spray-application zone. However, unless the tobacco is spread in a thin layer, the application of water droplets will not be uniform. The presently preferred practice is to effect contact between the tobacco and the water droplets by permitting the tobacco to fall through a zone of water droplets in order to obtain maximum uniformity of contact. The amount of water contacted with the tobacco under such conditions can be readily controlled by the concentration of the spray in the contact zone passes, the length of the contact zone through which the tobacco falls, and the rate at which the tobacco falls through this zone such as effected, for example, by the direction of the spray and by an updraft or downdraft existing intentionally or unavoidably in the contacting vessel.

After the tobacco has been contacted with the desired amount of hot water droplets for the requisite time to effect swelling of the tobacco cell walls as aforementioned, the puffed tobacco is frozen by any appropriate conventional means. For example, the puffed tobacco can be frozen by carrying it through or by allowing it to fall through, a refrigeration zone in which freezing is effected. However, a low-vacuum evaporative freezing, such as at pressures between about 5 mm and 0.01 mm of mercury, can be used in either of these handling procedures. When frozen it will be observed that there is a negligible amount of free ice on the expanded tobacco material. The frozen puffed tobacco is then dried by conventional low vacuum technique and moisture conditioned to about 11–14%.

A variety of means may be used for moisture conditioning including breaking the final freeze-drying chamber vacuum with steam, steaming the tobacco on a moving conveyer or holding the tobacco in a room or chamber having controlled humidity.

The following specific examples are illustrative, but not limitative, of the practice of the invention. In the examples all parts are given by weight unless otherwise indicated.

EXAMPLE 1

The lamina portion of flue-cured tobacco leaves, after curing and aging, was cut at a shred width of thirty-two cuts/inch and placed into a metal tray at a depth of one-half inch. Water at a temperature of 90° C. was reduced to spray particles of 0.1–3.0 mm diameter by air pressure and was applied to the tobacco at a ratio of four parts of water to one part of tobacco by weight. A second layer of tobacco was added and sprayed in like manner. The water was imbibed by the tobacco with resultant swelling of the latter. Within five minutes of completion of spraying, the tray containing the wetted tobacco was placed in a vacuum chamber and evacuated to a pressure of 2.5 mm of mercury which resulted in evaporative freezing. The frozen product was freeze-dried at a pressure of 0.5 mm of mercury with the product temperature being increased by indirect heating throughout the cycle to a maximum product temperature of about 180° F. The total treating time required for wetting, freezing and drying was about nine hours. The filling power of the tobacco was increased by a factor of 2.16 to 1 as measured after moisture equilibration in an atmosphere at 63% relative humidity and 80° F. Filling power is determined by placing 20 g of moisture conditioned tobacco in a calibrated cylinder having a diameter of approximately 50 mm. A pressure of 1.5 psig is applied during three minutes and the volume is read and compared with the volume of an unexpanded control sample.

EXAMPLES 2–10

In the following examples, Examples 2 and 3 were duplicate runs. Comparing Examples 2 and 3 with Example 4 shows that with infrared radiation, drying time was decreased by 33% and the filling power increase was essentially maintained. Examples 5 and 6 are for direct comparison. In these runs the tobacco/water ratio was decreased and the effect of adding infrared heat was to decrease drying time by 50%. Differences in filling power increases are within expected experimental variation.

An excellent comparison of conventional freeze-drying with the improved method of the present invention using the apparatus illustrated in FIGS. 3–4 are shown in Examples 7 and 8. For Example 7, the tobacco/water ratio was 1 to 3, the tray was solid metal, the product was contact frozen and only shelf heat was used. At the same water ratio in Example 8, an open mesh tray was used in conjunction with evaporative freezing and infrared heat. Drying time as reduced from six to only two hours and the filling power increase for this particular blend of tobacco was greater than for Example 7. Ampls 9 and 10 give additional information about the effect of decreasing the tobacco/water ratio. By this means, drying time was decreased but so was the filling power increase.

TABLE I

| Type of Tobacco(1) | Example No. | Tobacco to Water Ratio | Type of Tray Solid or Mesh | Freezing Method Contact or Evaporative | Heat Source Shelf, Infrared or Both(2) | Drying Time (hrs) | Filling Power (cc/g) | Filling Power Increase(3) (%) |
|---|---|---|---|---|---|---|---|---|
| Blend A | 2 | 1 + 3 | Mesh | Evaporative | Shelf | 3 | 10.50 | 94.3 |
| Blend A | 3 | 1 + 3 | Mesh | Evaporative | Shelf | 3 | 9.70 | 79.6 |
| Blend A | 4 | 1 + 3 | Mesh | Evaporative | Both | 2 | 9.50 | 75.9 |
| Blend A | 5 | 1 + 2 | Mesh | Evaporative | Shelf | 3 | 8.80 | 63.0 |
| Blend A | 6 | 1 + 2 | Mesh | Evaporative | Both | 1½ | 8.60 | 59.3 |
| Blend B | 7 | 1 + 3 | Solid | Contact | Shelf | 6 | 8.00 | 90.5 |
| Blend B | 8 | 1 + 3 | Mesh | Evaporative | Both | 2 | 8.45 | 101.5 |
| Blend C | 9 | 1 + 3 | Mesh | Evaporative | Both | 2 | 7.35 | 101.4 |

TABLE I-continued

| Type of Tobacco(1) | Example No. | Tobacco to Water Ratio | Type of Tray Solid or Mesh | Freezing Method Contact or Evaporative | Heat Source Shelf, Infrared or Both(2) | Drying Time (hrs) | Filling Power (cc/g) | Filling Power Increase(3) (%) |
|---|---|---|---|---|---|---|---|---|
| Blend C | 10 | 1 + 2 | Mesh | Evaporative | Both | 1½ | 5.35 | 46.6 |

(1)Blend A: A mixture of flue and air-cured tobaccos.
Blend B: Flue-cured tobacco.
Blend C: Another blend of flue-cured tobacco.
(2)Heat Source - "Both" describes the application of infrared heat to the top of the product with shelf heat applied to tray bottom.
(3)Filling Powers of Unexpanded Tobacco Blends:
Blend A - 5.40 cc/g
Blend B - 4.20 cc/g
Blend C - 3.65 cc/g Evaporatively freeze-drying as used herein is intended to define the process of vacuum induced, reduced pressure boiling of water which, upon partial evaporation, extracts heat from the water expanded tobacco and, correspondingly, causes the tobacco and remaining absorbed water to freeze the tobacco in the expanded condition. The remaining absorbed water in the frozen state is removed by infrared radiation heating which may be applied to the tobacco at any period of time either during the step of evaporatively freeze-drying or subsequently thereto if desired.

While the invention has been described in connection with the preferred embodiments, it is not intended to limit the invention to the particular forms set forth, but, on the contrary, it is intended to cover such alternatives, modifications and equivalents as may be included within the spirit and scope of the invention as defined by the appended claims.

What is claimed is:

1. An apparatus for expanding tobacco tissue which comprises, in combination, a vessel having at least one infrared radiation transparent shelf disposed therein, said vessel being in communication with a cold temperature condenser and said cold temperature condenser being in communication with a vacuum pump, water expanded tobacco disposed on said shelf, and infrared radiation elements disposed relative the said shelf to effect heating of the water expanded tobacco supported thereon.

2. The apparatus of claim 1 wherein the vessel contains a multiple number of said shelves.

3. The apparatus of claim 1 wherein reflectors are positioned about uppermost and lowermost infrared heating elements relative the said shelves.

4. The apparatus of claim 1 wherein infrared heating is effected during evaporatively freeze-drying of the water-expanded tobacco.

5. A tobacco product prepared using the apparatus of any one of claims 1 through 4.

* * * * *